United States Patent [19]

Cruchon et al.

[11] Patent Number: 4,731,596

[45] Date of Patent: Mar. 15, 1988

[54] BAND-PASS FILTER FOR HYPERFREQUENCIES

[75] Inventors: Jean-Claude Cruchon, Bouffemont; Gilbert Prost, Paris; Jean-Pierre Marquet, St Leu La Foret, all of France

[73] Assignee: Alcatel Thomson Faisceaux Hertziens, Levallois-Perret Cedex, France

[21] Appl. No.: 832,783

[22] Filed: Feb. 26, 1986

[30] Foreign Application Priority Data

Feb. 27, 1985 [FR] France ..... 85 02850

[51] Int. Cl.[4] ..... H01P 1/20

[52] U.S. Cl. ..... 333/204; 333/205

[58] Field of Search ..... 333/202, 203, 204, 205, 333/219, 235

[56] References Cited

U.S. PATENT DOCUMENTS

| | | | |
|---|---|---|---|
| 3,588,757 | 6/1971 | Andrascek | 333/204 |
| 3,605,045 | 9/1971 | Ramsbotham, Jr. | 333/204 |
| 4,319,208 | 3/1982 | de Bayser et al. | 333/204 |
| 4,418,324 | 11/1983 | Higgins | 333/204 |
| 4,578,656 | 3/1986 | Lacour et al. | 333/204 |

FOREIGN PATENT DOCUMENTS

| | | | |
|---|---|---|---|
| 0071508 | 2/1983 | European Pat. Off. | 333/204 |
| 0071509 | 9/1983 | European Pat. Off. . | |
| 1925610 | 12/1969 | Fed. Rep. of Germany . | |
| 2714181 | 10/1978 | Fed. Rep. of Germany | 333/203 |
| 2525835 | 10/1983 | France . | |
| 0166803 | 10/1983 | Japan | 333/204 |
| 0223902 | 12/1983 | Japan | 333/219 |
| 0074701 | 4/1984 | Japan | 333/202 |
| 0086306 | 5/1984 | Japan | 333/204 |

OTHER PUBLICATIONS

IEEE Transactions on Microwave Theory and Techniques (MTT vol. 31, No. 5, May 1983, pp. 392–404), by C. Mobbs et al.

IEEE Transactions on Microwave Theory and Techniques (MTT vol. 22, No. 5, May 1974, pp. 499–504), by E. G. Cristal et al.

*Primary Examiner*—Eugene R. LaRoche
*Assistant Examiner*—Seung Ham
*Attorney, Agent, or Firm*—Sughrue, Mion, Zinn, Macpeak, and Seas

[57] ABSTRACT

This highly reproducible stripline band-pass filter comprises, between its two leads (A and B), n halfwave resonators (1–7) connected in series. Suitable capacitors (C0–C7) provide a powerful coupling between the successive elements of the series circuit. Quarterwave resonators (10, 11, 70, 71) each having one end connected to the series circuit provide a steep-edge amplitude/frequency response at the limits of the pass-band of the hyperfrequency, wideband filter so obtained.

2 Claims, 5 Drawing Figures

BAND-PASS FILTER FOR HYPERFREQUENCIES

This invention concerns band-pass filters for electromagnetic waves belonging to the UHF and microwave ranges, i.e. included in the "hyperfrequency" category as defined by the International Electrotechnical Commission (IEC), and in particular concerns wideband filters and filters constructed with stipline waveguides.

The technique is known of constructing microwave band-pass filters, for example in the technological field of stripline transmission, by series connecting a low-pass filter and a high-pass filter; the low-pass filter consists of a series of narrow line sections and of wide line sections serving respectively as the inductive and capacitive elements of the filter; the high-pass filter consists of narrow line sections which are grounded and which serve as inductive elements and are connected together by open-circuited lines or capacitors. Such filters are required to have a large number of poles in the low-pass filter and in the high-pass filter, are required to include a large number of line sections. They are therefore bulky and costly.

Another type of such filters in the prior art consists of a series of resonators disposed between the entrance and the exit of the filter, which are powerfully coupled together; the resonators are placed very close to one another to obtain a powerful coupling. This type of filter is difficult to manufacture, even in stripline or microstrip form, if the desired coupling entails that any two successive resonators be spaced less than 100 microns apart, because this coupling must be perfectly constant from filter to filter to ensure consistent characteristics for all filters in a given production run.

It is the object of this invention to obviate, or at least abate, the above-mentioned disadvantages.

The improvement of the invention basically resides in a resonator-type filter in which on the one hand the coupling of successive resonators is reinforced by means of suitably disposed capacitors and on the other hand a band-stop capability is introduced.

The invention provides a band-pass filter for hyperfrequency electromagnetic waves, comprising, all connected in series from an electrical standpoint, $n+2$ elememts (n being a positive whole number) formed by an input line, n linear resonators each open at both ends and substantially of a given length $\xi b/2$, and an output line, the resonators being arranged in the order of the first to the nth between respectively the input line and the output line, wherein a combination of $n+1$ capacitive couplings are provided to respectively couple the input line to the first end of the first resonator, the second ends of the i-th resonators to the first ends of the $(i+1)$th resonators (where i is a whole number from 1 to $n-1$, inclusive) and the second end of the nth resonator to the output line, and at least one pair of linear resonators of length $\lambda s/4$ ($\lambda s$ being the wavelength to be filtered out and being less than $\lambda b$), the resonators of any given pair each having one end connected to one of the $n+2$ elements and being spaced an electrical distance $(2k+1)\lambda b/4$ apart (where k is a whole number greater than $-1$).

The invention will be more readily understood, and others of its features be made apparent, in reading the following description with reference to the appended drawings in which.

Figure 3:
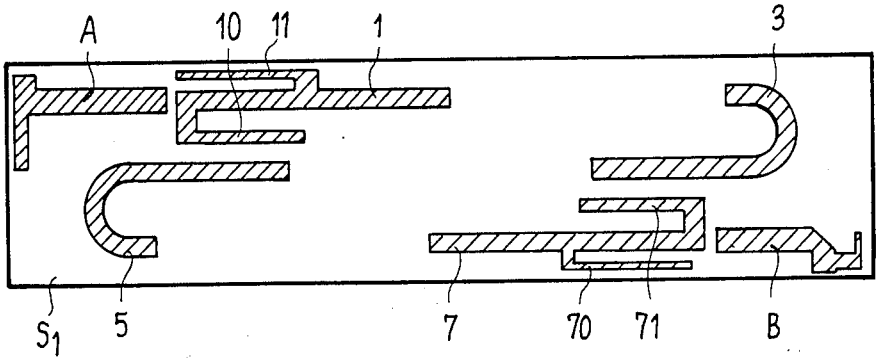
Figure 4:
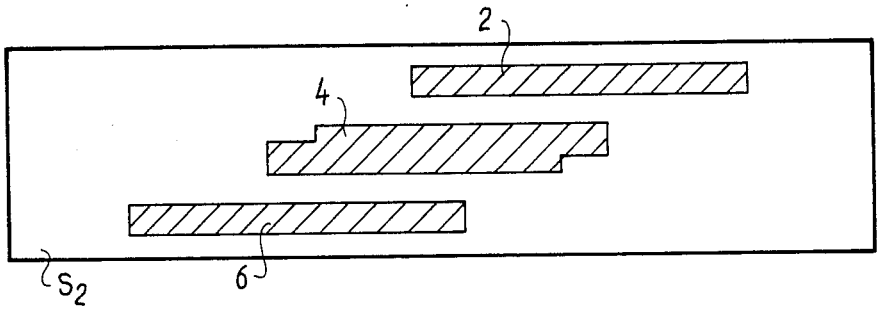
Figure 5:
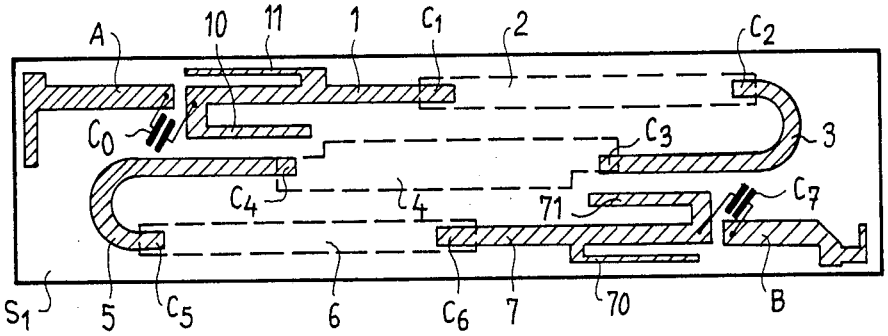

and FIGS. 3 through 5 illustrate a second embodiment of the invention.

Like parts are designated by like references in the different figures.

Figure 1:
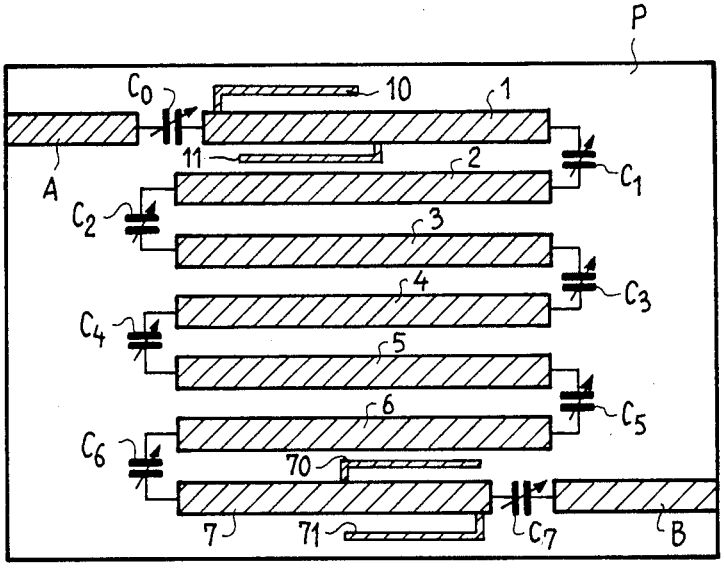
FIG. 1 illustrates a first embodiment of a filter according to the invention.

As can be seen by examining FIG. 1, the stripline filter according to the invention comprises a substrate P of polytetrafluoroethylene glass, commercially known as Teflon Glass, in the form of a rectangular plate 45 mm wide, 65 mm long and 1.6 mm thick. The hidden face of said substrate P is entirely covered with copper deposited threon to serve as a ground plane; on the visible face, deposited copper strips A, 1 through 7, 10, 11, 70, 71 and B form respectively an input line, seven linear resonators open at both ends, four auxiliary linear resonators each short-circuited at one end, and an output line. Attention is drawn to the fact that although the filters as described herein and in the accompanying claims are described as having an input line such as A in FIG. 1 and an output line such as B in the same figure, the functions of these two lines could in fact be reversed such that line A serve as the output lead and line B as the input lead. The filter according to FIG. 1 is of the type having striplines physically arranged in parallel. Indeed, the resonators 1 through 7 consist of line sections disposed in parallel to ensure compactness for the filter. The line sections disposed between said input and output lines A and B. Resonators 1 through 7 are half-wave conductive strips, all substantially $\lambda b/2$ in length, where $\lambda b$ is the wavelength corresponding to the center frequency of the filter pass-band. To obtain a powerful coupling between the successive stripline sections of the filter and ensure that this coupling is easily reproducible from one filter to the next in production, variable capacitors C0 to C7 are provided to link respectively the line A to the first end of the resonator 1, the second end of resonator 1 to the first end of resonator 2 and so on up to the second end of resonator 6 and the first end of resonator 7 and the second end of resonator 7 to the line B; said line sections 1 through 7, together with the capacitors C1 through C6, thus form a zigzag pattern.

The four auxiliary resonators 10, 11, 70 and 71, which are quarterwave lines, are short-circuit connected by connecting one of their ends to the corresponding main resonator, namely main resonator 1 for auxiliary resonators 10 and 11, and main resonator 7 for auxiliary resonators 70 and 71. These short-circuit resonators are designed to introduce a band cutoff capability in the filter so that, as will be seen in FIG. 2, the filter's amplitude/frequency response curve will have a steeper-edged pass-band toward the higher frequencies. Accordingly, the length of said auxiliary resonators is selected to be equal to $\lambda s/4$ where $\lambda s$ is a wavelength to be rejected, less than $\lambda b$ and substantially the same as the center frequency of the frequency band to be excluded by the band cutoff. The auxiliary resonators are associated in pairs, namely 10–11 and 70–71 and the resonators of a pair are spaced apart a distance equal to $(2k+1)\lambda b/4$, with k a positive whole number set equal to 1 in the example described. The choice of this spacing between the auxiliary resonators affords a mutual compensation, in the filter's pass-band, of the inductive and capacitive disturbances introduced by each of the resonators in a same pair. Attention may also be drawn to the fact that said auxiliary resonators associated with the notching or band cutoff function can actually be located anywhere along the electrical path between the two filter leads as long as the said distance between them of (2 k+1) λb/4 is maintained. The filter just described has a frequency passband at 3 decibels of 950 to 1700 MHz, with a sharp attenuation to 30 decibels on both sides of this band.

Figure 2:
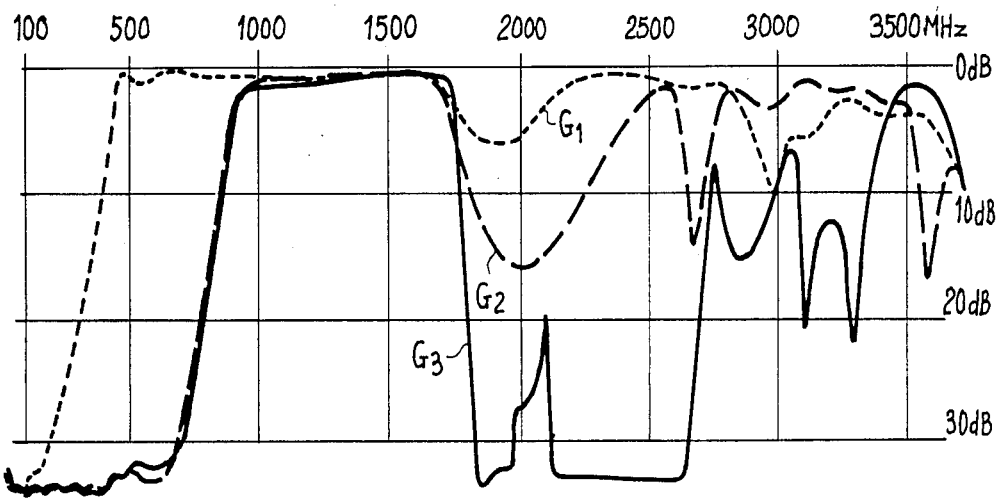
FIG. 2 shows the frequency response curves of the filter according to FIG. 1.

A graph of the amplitude/frequency response curves for the filter represented in FIG. 1 is given in FIG. 2, showing three curves G1, G2 and G3.

Curve G1 represents the response of the circuit of FIG. 1 when provided with high-valued coupling capacitors C0 to C7 (C0 and C7=20 pF and C1 to C6=5 pF) but lacking any auxiliary resonators 10, 11, 70, 71; this curve is substantially that of a high-pass filter providing an attenuation of more than 30 dB for frequencies below 200 MHz, changing from 30 dB to 1 dB between 200 and 500 MHz, then of the order of 1 to 2 dB between 500 and 1600 MHz (flat response) and thereafter varying from 1 to 11 dB for the remainder of the frequencies covered by the measurement, ie. between 1600 and 3750 MHz. This frequency response is far from corresponding to the passband of the filter shown in FIG. 1, namely 950–1700 MHz.

Curve G2 of FIG. 2 represents the amplitude/frequency response of the circuit of FIG. 1 without the auxiliary resonators 10, 11, 70, 71 but with the capacitors set as in the inventive filter, as for G3 (C0, C7=15 pF, C1 and C6=3 pF, C2 to C5=1.5 pF). The response is as desired for the low frequencies but in the high frequencies the attenuation is insufficiently sharp.

Curve G3 represents the amplitude/frequency response of the circuit shown in FIG. 1; comparing this curve with curve G2 makes it apparent that adding the notch filter, providing a stop-band roughly centered on 2300 MHz by means of the quarterwave lines the resonance frequencies whereof are selected to lie in the 1850–2500 MHz band, has the effect of bringing about a sharp change in attenuation in the neighborhood of the high frequecies of the bandpass filter: attenuation of less than 3 dB below 1750 MHz and of the order of 20 to 30 dB for frequencies rom 1800 MHz to more than 2500 MHz; the attenuation is again lessened at frequencies of the order of 2700 MHz and above, but the latter frequencies are sufficiently removed from the filter bandwidth (950–1700 MHz) to avoid any adverse effects in most applications of the filter.

Another embodiment of the filter according to the invention will now be described with reference to FIGS. 3 through 5; this filter has in fact the same characteristics as the filter according to FIG. 1, but is fabricated with two conductive layers plus a ground plane on flexible substrates and the capacitors thereof corresponding to the capacitors C1 to C6 of FIG. 1 are obtained by overlapping the ends of lines which are separated by the thickness of a flexible substrate.

FIG. 3 shows a flexible substrate of polyamide S1 on which six copper strips have been deposited: A, 1+10 and 11, 3, 5, 7+70 and 71, and B. FIG. 4 shows another flexible polyamide substrate S2 on which three copper strips have been deposited: 2, 4 and 6. The substrates S1 and S2 are two 35×144 mm rectangular plates which are then glued one upon the other to produce the circuit assembly represented in FIG. 5. Also glued beneath the plates S1 and S2 is a ground plane consisting of a polyamide substrate one face whereof is coated with a cuprous deposit; this ground plane is not visible in FIG. 5.

To constitute a filter comparable to that of FIG. 1, it is only necessary to add to the assembly formed by the plates S1 and S2 and their deposition strips and ground plane two miniature fixed capacitors rated at 15 picofarads each, designated C0 and C7 in FIG. 5. As in FIG. 1, the input and output lines are labelled respectively A and B, the halfwave line resonators are labelled 1 through 7 and the quarterwave resonators are labelled 10, 11, 70 and 71. The capacitive couplings between line A and resonator 1 and between resonator 7 and line B are respectively realized by the capacitors C0 and C7. However, the couplings between the halfwave resonators are obtained in this case by aligning the ends to be coupled; the facing surfaces, separated by the dielectric of the polyamide substrate, thus form the two plates of the coupling capacitors; these capacitors bear the references C1 to C6 in FIG. 5.

Various other constructions of a band-pass filter are possible without departing from the scope of the invention. For instance, the filter according to the invention can be designed with a three-plate structure, in other words with the resonators disposed in the space separating two parallel ground planes. Likewise, on the basis of the embodiment according to FIG. 1, the capacitors C1 to C7 can be made using metal tabs deposited onto a dielectric substrate; such tabs would be arranged so that, to replace the capacitor C1 of FIG. 1 for example, the two ends of the tab align with the respective ends of the resonators 1 and 2 to which said capacitor C1 was connected; the areas so aligned determine the coupling between successive rsonators. Capacitors such as C0 and C7 in FIGS. 1 and 5 can likewise be obtained by this technique of facing surface areas of copper, or alternatively by the technique illustrated in FIG. 5 or equivalent. This is possible by giving the facing ends large enough surface areas according to the thickness and the permitivity of the dielectric separating them and the capacitance sought.

It is also possible to construct a filter comprising only a single halfway type resonator and a single pair of quarterwave resonators.

We claim:

1. Band-pass filter for hyperfrequency electromagnetic waves, comprising, in series from an electrical standpoint, n+2 elements (n being a positive integer) formed by an input line, n linear resonators open at both ends and all sustantially of a given length b/2, and an output line, the resonators being arranged in the order of the first to the n-th between respectively the input line and the output line, wherein a combination of n+1 capacitors are provided to respectively couple the input line to the first end of the first resonator, the second ends of the i-th resonators to the first ends of the (i+1)th resonators (i being an integer from 1 to n−1, inclusive) and the second end of the n-th resonator to the output line, and at least one pair of auxiliary linear resonators of length λs/4 λs being the wavelength to be rejected and less than λb) where b is the wavelength corresponding to the center frequency of the filter passband, the auxiliary λb/4 resonators of a pair, each pair having one end connected to one of the n+2 elements and being spaced an electrical distance (2 k+1) apart (k being an integer greater than −1), and wherein the linear resonators are half wave conductive strips open at both ends and situated in parallel and along at least a part of their length which are colinear to create a highly compact filter and permitting the auxiliary resonators to be located anywhere along the electrical path between the two filter leads as long as the distance therebetween is maintained at (2 K+1)λb/4.

2. Band-pass filter according to claim 1, wherein the n+2 elements are constructed according to the stripline waveguide technique, said n+2 elements being distributed on the two sides of a same dielectric substrate and at least one of the n+1 capacitors between two elements being obtained by aligning one end of one of said elements with one end of the other of the two said elements, the two said elements being disposed for the purpose in opposite ends of the substrate and the surface area of their facing ends being determined as a function of the capacitance that is sought.

* * * * *